US006230529B1

(12) United States Patent
Persson

(10) Patent No.: US 6,230,529 B1
(45) Date of Patent: May 15, 2001

(54) TOOL FOR TUBULAR KEY LOCKS

(76) Inventor: Kenneth E. Persson, 330 E. Elem St., East Rochester, NY (US) 14445

( * ) Notice: Subject to any disclaimer, the term of this patent is extended or adjusted under 35 U.S.C. 154(b) by 0 days.

(21) Appl. No.: 09/365,327

(22) Filed: Jul. 30, 1999

(51) Int. Cl.[7] ..... F05B 19/20
(52) U.S. Cl. ..... 70/394; 70/398; 70/404
(58) Field of Search ..... 70/394, 395, 491, 70/403, 404, 397, 398, 401, 408, 409, 411, 412; 33/539, 540

(56) References Cited

U.S. PATENT DOCUMENTS

| | | | | |
|---|---|---|---|---|
| 2,059,376 | | 11/1936 | Lombardo | 70/394 |
| 2,070,342 | | 2/1937 | Tarrie | 70/394 |
| 2,595,267 | * | 5/1952 | Julliard | 70/387 |
| 2,655,808 | | 10/1953 | Wilson | 70/394 |
| 3,149,487 | | 9/1964 | Martin | 70/394 |
| 3,251,206 | | 5/1966 | Gruber | 70/394 |
| 3,270,538 | | 9/1966 | Kerr | 70/394 |
| 3,330,141 | | 7/1967 | Greenwald | 70/411 |
| 3,808,853 | * | 5/1974 | Helenurm | 70/411 |
| 4,094,176 | | 6/1978 | Hughes | 70/394 |
| 4,185,482 | | 1/1980 | Nail | 70/394 |
| 4,229,959 | | 10/1980 | Easley | 70/394 |
| 4,517,746 | | 5/1985 | Easley | 33/549 |
| 4,535,546 | | 8/1985 | Smith | 33/540 |
| 4,617,813 | | 10/1986 | Christopher et al. | 70/394 |
| 4,667,494 | | 5/1987 | Joosten | 70/394 |
| 5,172,578 | | 12/1992 | Bitzios | 70/394 |
| 5,224,365 | | 7/1993 | Dobbs | 70/394 |
| 5,325,691 | | 7/1994 | Embry | 70/394 |

* cited by examiner

*Primary Examiner*—Lloyd A. Gall
(74) *Attorney, Agent, or Firm*—Harter, Secrest & Emery; Brian B. Shaw, Esq.; Stephen B. Salai, Esq.

(57) ABSTRACT

A tool is disclosed for opening tubular locks in which a tubular key is receivable. The tool includes a plurality of probes that are releasably retained and secured in a given position to align the shear points in the lock in an opening position. The probes can be ergonomically and individually manipulated and have a course and a fine adjustment, such that the shear point of each tumbler can be easily and efficiently determined. Once the shear point is determined, the probe may be fixed in the position to maintain each tumbler driver.

13 Claims, 4 Drawing Sheets

TOOL FOR TUBULAR KEY LOCKS

FIELD OF THE INVENTION

The present invention relates to tools for opening locks without the use of a key and more particularly to a locksmith tool for tubular locks, wherein the tool provides a plurality of probes that are biased by the tumblers and selectively securable in a given position.

BACKGROUND OF THE INVENTION

The present invention is directed to locksmith tools, and more particularly, to a picking tool for tubular locks of the type wherein the front end portion of a cylinder is rotatable within a casing and cooperates with the casing to define an annular keyway in which a tubular key is receivable, the key having a series of recesses on its front end that cooperates with spring biased tumblers in the lock which move parallel to the lock axis.

Tubular key locks are frequently used to gain access to coin boxes of vending machines, on switches that control electrical circuits of automobile burglar alarms systems, on coin boxes of gambling instruments, plus numerous other types of equipment. The tubular key that is accepted by the lock of this type is not as readily duplicated as a more conventional flat key intended for a cylinder lock having a slot-like key receiving aperture. Tubular key locks also have the further advantage that they cannot readily be picked by means of conventional picking tools.

Upon occasion, however, there are legitimate reasons for having a tubular key type of lock picked by a locksmith. Traditional picking devices for the tubular type of lock are not efficient, and generally, even the most skilled locksmith will take a substantial period of time to open a tubular type of lock with such a device.

Previously, such picking devices have been designed to fit only one particular type of lock. In actual practice, there are several different sizes of locks with center pin sequences, offset left and offset right pin sequences. Therefore, the picking tools of the prior art are not adaptable to the nonconventional size of tubular lock, or the offset pin sequences.

Almost all tubular cylinder locks at the present time, include seven (7) in number of tumblers. However, there is currently being manufactured a tubular cylinder lock which includes eight (8), or more tumblers.

Tubular key locks, such as those sold under the trademark "ACE" and "GEM", are frequently used on coin boxes of vending machines and on switches that control the electrical circuits for audible burglar alarm systems.

However, the need still exists for a tool for assisting locksmiths in opening tubular locks. The need also exists for a tool that provides sufficient feedback to an operator to assist in locating the shear points of the tumblers in the lock. A further need exists for a tool that can retain a tumbler in a given position, wherein the shear point is located in an opening position of the lock.

SUMMARY OF THE INVENTION

It is a general object of the present invention to provide a locksmith tool for the selectively opening a tubular key type, wherein the lock can be opened relatively quickly and without extensive training.

More specifically, it is an object of the present invention to provide a tool whereby torsional force can be applied to the cylinder of a tubular key type of lock simultaneous with the application of axial force to each of the tumbler drivers of the lock, so that the tumblers can be individually depressed against the bias of the respective springs, until each tumbler driver and its tumbler are brought to a position in which their adjacent ends are in the line of shear of the lock. It is a further object of the present invention to maintain a tumbler driver in an openable position with respect to the shear line, while the shear line of the remaining tumblers is determined.

The present invention provides a plurality of probes that can be individually manipulated, wherein the individual motion includes a coarse and a fine adjustment, such that the shear point of each tumbler can be easily, individually and efficiently determined. Once the shear point is determined, the probe may be fixed in the desired position.

The present invention includes a tool for picking a lock, including a main housing having a lock end, a manipulator end and a plurality of pathways having a first opening at the manipulator end and a second opening at the lock end; and a plurality of throw controls connected to the housing, each throw control including; (i) a threaded barrel sized to engage a corresponding threaded section on the housing; (ii) an elongate flexible probe sized to be slideably received through the pathway and a length of the barrel; (iii) a plunger connected to the probe; (iv) a retaining cap threadingly engaged to the barrel to capture a portion of the plunger therebetween, the retaining cap movable with respect to the barrel to locate the plunger relative to the barrel, and hence, probe relative to a corresponding tumbler. The throw control thus provides a limited amount of longitudinal displacement of the probe, as well as longitudinally shifting the location of the throw.

DETAILED DESCRIPTION OF THE PREFERRED EMBODIMENT

Figure 2:
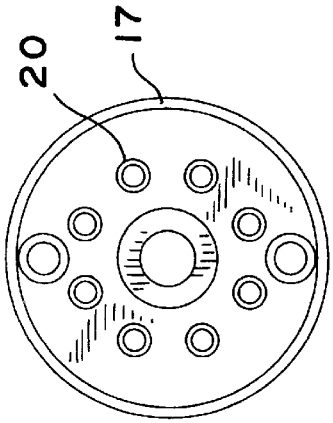
FIG. 2 is an end view of the housing.
Figure 1:
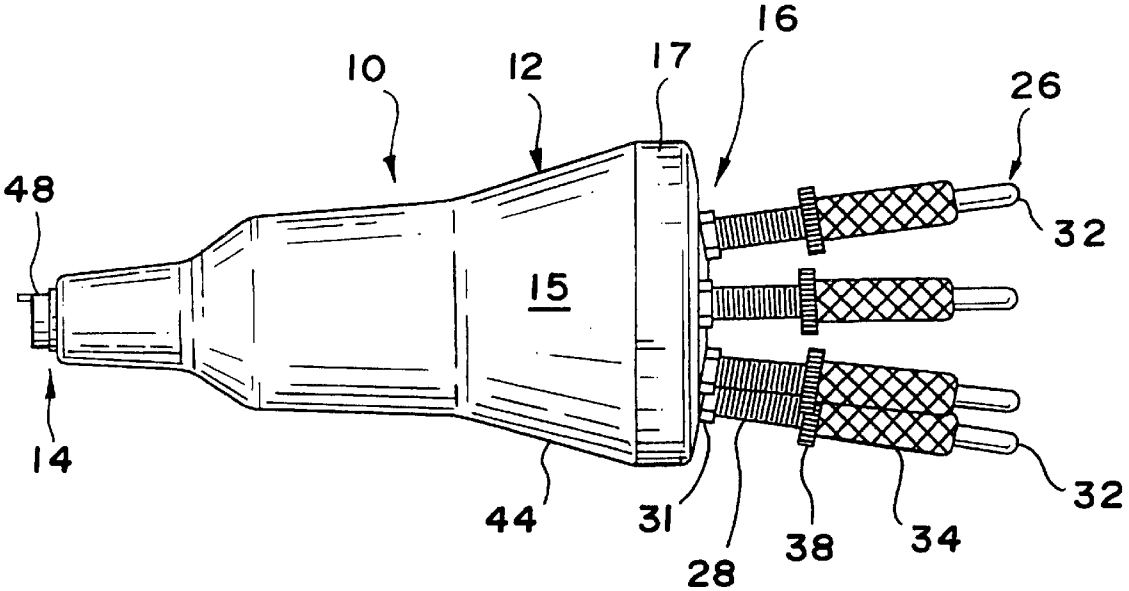
FIG. 1 is a side elevational view of the tool.

As shown in FIG. 1, the present invention provides a tool 10 for opening with a key lock without the use of a traditional key.

The lock to which the tool 10 is be adapted, includes a generally tubular stud, on one end of which is mounted a closure cap. A mounting nut is threaded to the stud for the purpose of securing the lock enclosure (not shown). A facing plate is received in the stud behind the closure cap, and a spacer is received in the stud behind the facing plate. At the opposite end of the stud is a locking arm. The locking arm is secured by a nut, to a threaded extension of the lock cylinder which is contained within the stud.

Figure 3:
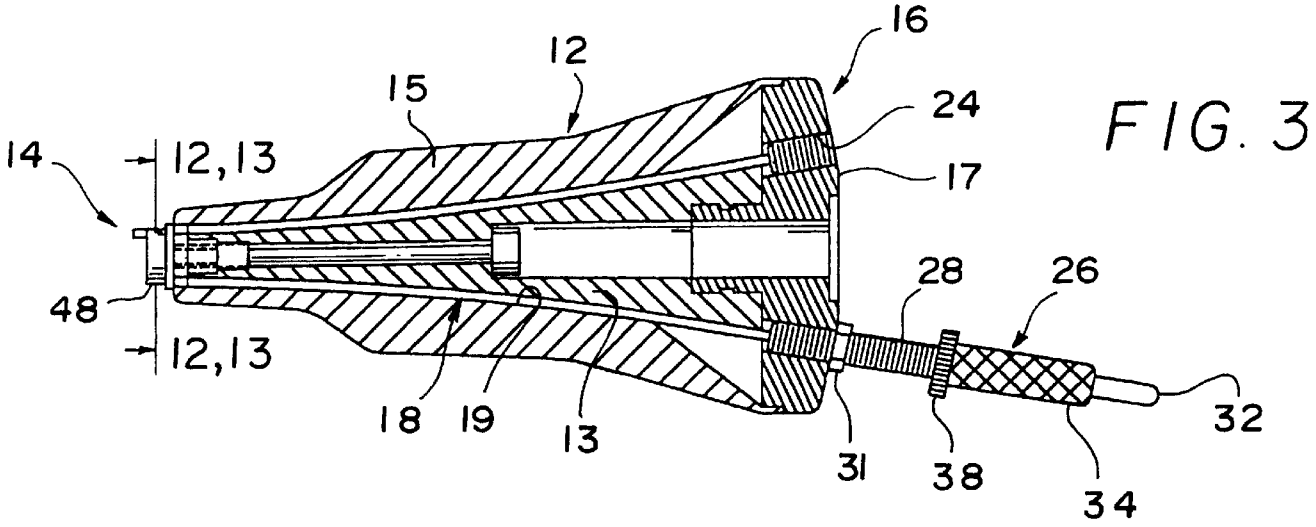
FIG. 3 is a partial cross sectional view of the device of FIG. 1.
Figure 4:
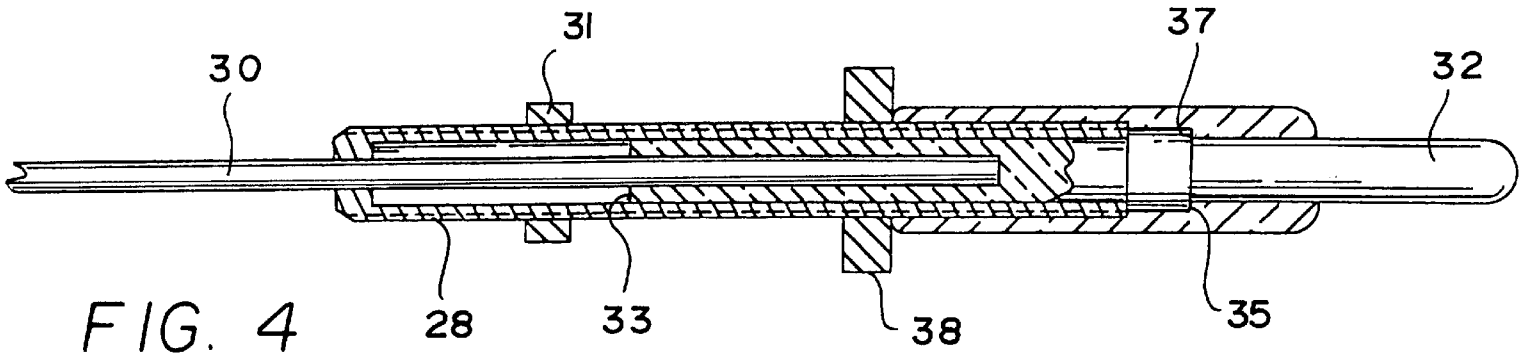
FIG. 4 is an enlarged cross sectional view of the throw mechanism.
Figure 7:
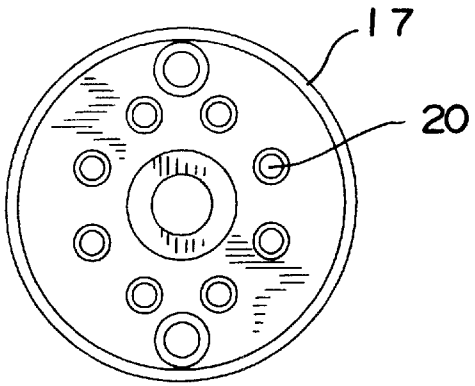
FIG. 7 is a front end view of the end cap.
Figure 6:
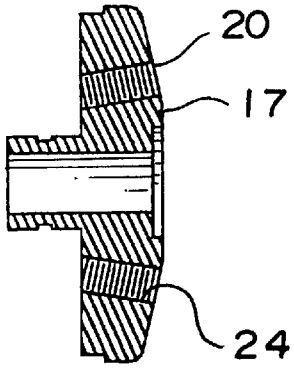
FIG. 6 is a cross sectional view of the end cap.
Figure 5:
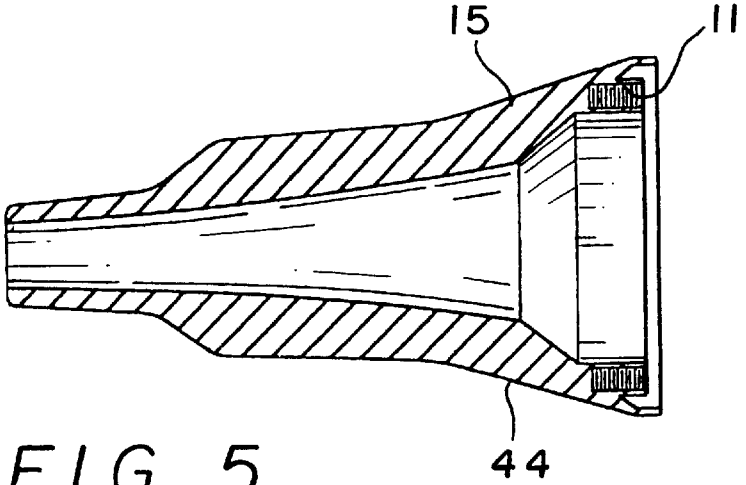
FIG. 5 is a longitudinal cross sectional view of the outer housing.
Figure 8:
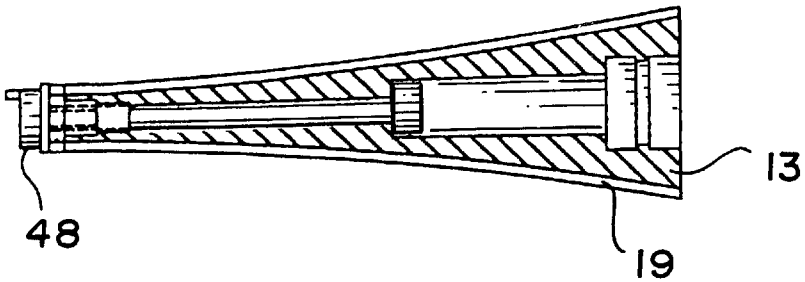
FIG. 8 is a longitudinal cross sectional view of the inner housing.
Figure 9:
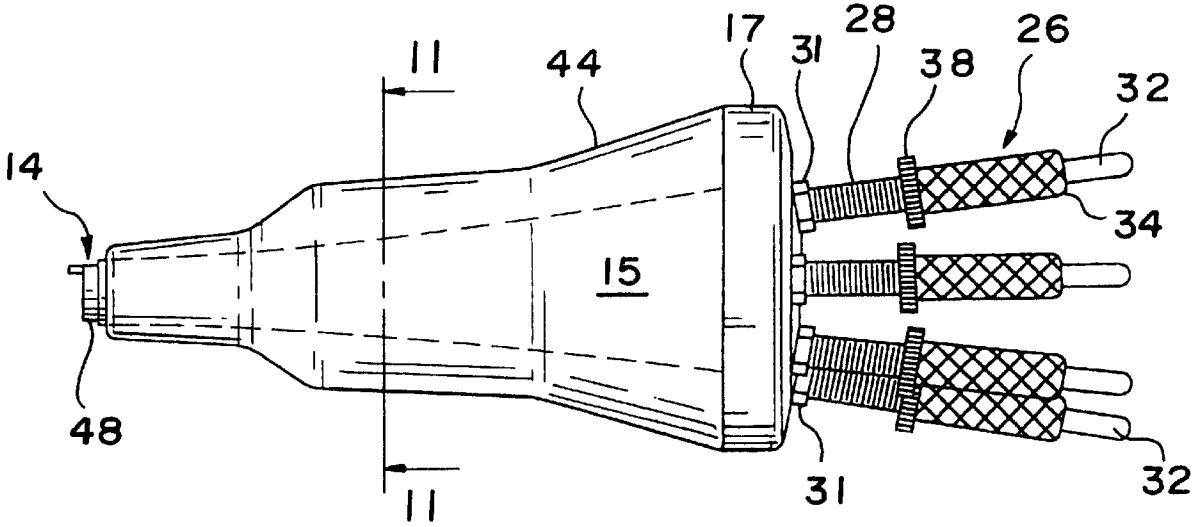
FIG. 9 is a side elevational view showing a pathway.
Figure 13:
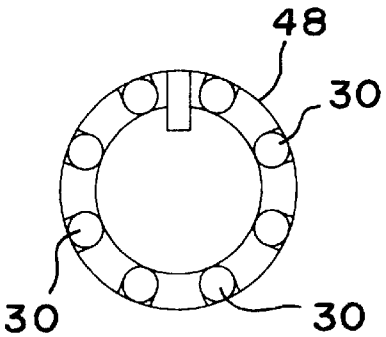
FIG. 13 is an end view of an eight probe tool.
Figure 11:
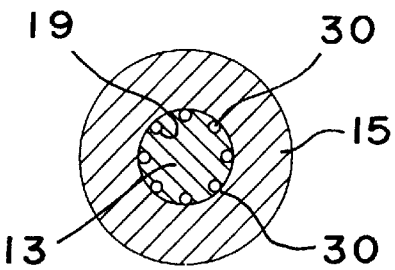
FIG. 11 is a cross sectional view taken along line 11—11 of FIG. 9.
Figure 10:
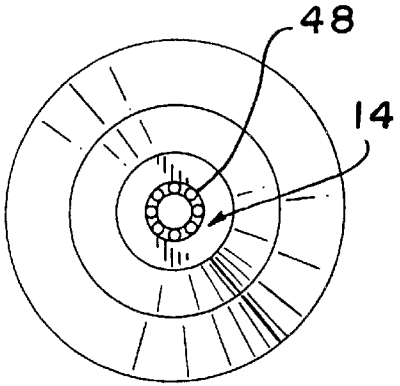
FIG. 10 is an end view of the tool.
Figure 12:
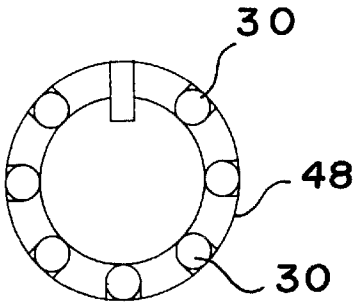
FIG. 12 is an end view of a seven probe tool.

Referring to FIGS. 1, 3, and 9, the tool 10 includes a housing 12, a plurality of probes 30 and a corresponding plurality of throw controls 26.

The housing 12 in the form of a generally cylindrical body machined, molded on formed from a material such as hard plastic, polymer, metal, or hard rubber. The housing 12 has two diameters, including a relatively large diameter, characterizing a manipulator end 16 and a lock end 14, having a relatively small diameter. The manipulator end 16 is grasped by the operator who uses the tool 10 to open the lock. An outer surface of the flared section 44 of the housing may be knurled to facilitate manipulation of the tool 10. The circumference of the manipulator end is sized to provide access to each probe without excessive interference with an adjacent probe. The housing 12 includes a plurality of pathways 18 extending from the manipulator end 16 to the lock end 14. The pathway 18 are sized to slidably receive a corresponding probe 30. For example, with a 7 probe pick, the pathways 18 are located about a 1.5 inch diameter circle. However, as the pathways 18 diverge as they extend toward the manipulator end, the throw controls 26 are located on an approximately 2 ¼ inch circle. Thus, the user has sufficient room to operate the throw controls 26.

The remainder of the main housing 12 has a reduced diameter, terminating at the lock end 14. The lock end of the housing includes a lock piece 48 for aligning the pathways 18 with the lock. For tubular locks, the lock piece 48 has a generally circular cross section with a plurality of longitudinal grooves extending along an outer surface of the tip similar to a tubular key.

As stated, the main housing 12 includes a number of longitudinally extending pathways 18 having a first opening 20 at the manipulator end 16 and a second opening at the lock end 14, and specifically at the lock piece 48. Each pathway 18 is adjacent or extends through a threaded section 24. The number of pathways 18 may vary, however, in a preferred embodiment there are seven pathways. That is, there may be 4, 5, 7, 8, 9 or 10 pathways. The number of pathways is determined by the number of tumblers in the lock. The pathways are constructed to resist movement of the probes 30 along the respective pathway. Thus, the pathway may include pinch points to provide the resistance to longitudinal displacement of the corresponding probe.

The housing 12 may be formed of substantially single piece construction or of multiple components. For example, the pathways 18 may be defined by an inner body 13 and an outer body 15, wherein the inner body is received within the outer body. An end cap 17 may be connected to the inner body and the outer body to partially define the pathways 18. The outer body 15 defines the flared section 44 and may include the desired surface features such as knuling. The inside of the outer body 15 is sized to slidably receive the inner body 13. The outer body 15 includes threaded retaining mounts 11 for receiving a fastener to receive the inner body 13 and end cap 17 to the outer body.

The inner body 13 is a generally tapered element having a plurality of grooves or channels 19 on the outer surface. The channels 19 are sized to slideably receive the probe 30. The lock piece 48 is connected to the lock end of the inner body 13 by any suitable manner such as function fit, threads or adhesives. The channels 19 and the inside of the outer body 15 cooperate to form a portion of the pathway 18.

The probe 30 is an elongated flexible member, preferably a flexible wire, sized to be slidably received through the pathway 18, and a length of a barrel 28. Each probe 30 extends from a proximal end at the throw control 26 to distal end at the lock piece 48. Preferably, the probe 30 does not exhibit a favored direction of flex. That is, the probe 30 is equally flexible in each direction perpendicular to its longitudinal axis. The probes 30, which are formed of substantially cylindrical wires, serve to longitudinally displace the lock tumblers in the lock. The probes 30 must be longitudinally slidable within the pathways 18, in order to move to whatever position is required by the code of any lock, which might be encountered. That is, the probes 30 must be movable to respective positions which correspond to locations of the code of any key blade. The pathways 18 and the probes 30 are sized to preclude kinking or folding of the probe within the pathway. The probes 30 and the pathways 18 may be sized so the probes do not freely move. That is, there is at least a slight resistance along the pathway 18. As best seen in FIG. 3, the diameter of the wires from which the probes 30 are formed is slightly less than the diameter of pathways 18 in which they are received. Each probe 30 may be provided with markings comprising lock code indicia, which can be read to reveal a lock code, so that a new key can be cut for the owner of the lock. A particular lock code indicia may be imprinted on each probe to indicate the lock opening position for a particular lock tumbler with which that probe is engaged.

Referring to FIGS. 1, 3, 4, and 9, a plurality of throw controls 26 are connected to the housing 12. Each throw control 26 includes the threaded barrel 28, a correspondingly threaded cap 34, a plunger 32, and a lock mechanism. The throw control 26 allows for the selective movement of the probe 30 relative to the housing 12 and particularly the lock piece 48. In addition, the throw control 26 provides for the selective retention of a probe 30 at a given extension.

The threaded barrel 28 is threaded into a threaded section 24 of a corresponding passageway in the housing 12. The threaded barrel 28 has a threaded outer surface. Retention of the threaded barrel 28 relative to the housing 12 may be accomplished by disposing a nut 31 on the threads of the barrel 28. Specifically, the nut 31 may be threaded along the barrel 28 to contact the housing 12 and preclude rotation of the barrel relative to the housing. Thus, by rotating the barrel 28 relative to the housing 12 and tightening the nut against the housing, the length of barrel extending from the housing can be readily adjusted. As discussed subsequently, this provides a coarse adjustment or location of the throw.

The plunger 32 is connected to a corresponding probe 30. The plunger 32 may be connected to the probe 30 at the proximal end. The plunger 32 is sized to be partially received within the threaded barrel 28. The plunger 32 includes an insertion stop shoulder 33 for contacting a portion of the threaded barrel 28 and precluding complete passage of the plunger through the barrel. Thus, the probe 30 and the plunger 32 may be moved in the longitudinal direction of the probe and specifically toward the lock piece 48, while motion of the probe toward the lock piece is limited by contact between the insertion stop shoulder and the threaded barrel 28. The plunger 32 also includes an extraction stop shoulder 35.

In an alternative configuration, the plunger 32 is omitted and the proximal end of a probe 30 extends rearwardly of the housing 12, and may be bent at an oblique angle to the longitudinal direction, so as to provide a convenient handle for individual manipulation of each probe 30. The insertion and extraction stops are affixed or crimped to the probe 30.

However, in preferred embodiments, the plunger 32 is employed and the probes 30 do not include the oblique angle.

A retaining cap 34 is engaged, preferably threadingly, to the barrel 28, to capture a portion of the plunger 32 between a terminal end of the threaded extension and the cap. Specifically, the retaining cap captures the insertion stop shoulder and the extraction stop shoulder between the barrel 28 and the retaining cap. The retaining cap 34 is a generally cylindrical member having a longitudinally extending aperture therethrough. The retaining cap 34 includes an inwardly extending retaining collar 37 sized to contact the extraction stop shoulder 35 of the plunger 32. Thus, the plunger 32 is movable between contacting the insertion stop against the threaded barrel and contacting the extraction stop against the extraction stop shoulder. Movement is defined as the throw of the probe. The retaining cap 34 and the plunger 32, may be made of any suitable material, such as plastic, metal, composites or polymer.

The distance between contacting the insertion stop against the threaded barrel 28 and the extraction stop against the collar defines a throw. The throw of the lock 36 allows an operator to assess the relative resistance of a given tumbler (spring) against a spring in the lock against a probe 30, to determine the appropriate location of the shear points in the lock. A retaining cap lock 38 is provided for releasably positioning the retaining cap 34 relative to the barrel 28.

The retaining cap lock 38 is a nut threaded onto the threaded barrel 28 between the coarse nut and the retaining cap 34. As the retaining cap lock 38 is threaded against the retaining cap 34, further motion of the retaining cap along the threaded barrel 28 is precluded. Thus, motion of the probe 30 away from the lock piece 48 is precluded and the probe extends a given distance from the lock piece.

The throw controls 26 may be comprised of any suitable material, preferably metallic material such as aluminum or brass. The threaded barrel 28 is also preferably comprised of metallic material. The threaded extension 24 is connected to the housing and extends from the housing along the splay of the housing.

Operation

In utilizing the tool for opening the lock, the tool 10 is operably connected to a lock to dispose the lock piece 48 in the lock. The flexible probe 30 is translated along a longitudinal axis of the probe 30 to contact the terminal end of the probe with a corresponding tumbler in the lock. If necessary, the threaded barrel 28 may be rotated with respect to the housing 12 to provide the coarse adjustment of the throw. That is, the threaded barrel 28 is adjusted to locate the available motion of the tumbler within the throw of the throw mechanism. Once the coarse adjustment is made, the fine adjustments via the throw controls 26 are initiated.

As the tumbler is biased by a spring in the lock, there is resistance to movement of the probe 30 upon contact with the tumbler. Motion of the probe 30 is continued by exerting pressure on the plunger and the plunger slides relative to the threaded barrel 28. Upon the shear point being located, the retaining cap is secured by the retaining cap lock and the extraction stop contacts the collar and the plunger 32 is precluded from further extraction from the threaded barrel 28. Thus, the given tumbler is located at the shear point and the operator can move to the next tumbler for adjustment.

This process is repeated until each tumbler has been aligned at its respective shear point. Upon all the tumblers being aligned with their respective shear points and the corresponding retaining caps locked, the housing 12 is rotated to effectively turn the key and unlock the lock.

As each probe 30 may be provided with the lock code indicia, which can be read to reveal a lock code, a new key can be cut for the owner of the lock. The aggregate reading taken from the indicia on all probes constitutes the complete probe for a given lock, from which a replacement key can be made.

The tool of the present invention is adapted to function with the coplanar tumbler type of lock, and is able to operate within the confines of a narrow axis opening key way of such a lock. The present tool incorporates a Unique structure for imposing frictional restraint or "drag" on the tumbler probes, which are adjustable for cooperation with locks having tumblers under various degrees of spring pressure. The picking tool further embodies a unitary housing for internally mounting the tumbler probes, and securing the tumblers, thus serving to mount the probe restraining and probe locking structure thereon, to provide a compact and readily manipulable precision tool.

While preferred embodiments of the picking tool of the invention have been illustrated and described, reference has been made to certain changes and modifications, which may be made therein, it will be apparent to those skilled in the art that various additional changes and modifications may be made therein, within the spirit and scope of the invention. It is intended that all such changes and modifications be included within the scope of the appended claims.

I claim:

1. A tool for opening a lock, comprising:

(a) a housing having a lock end, a manipulator end and a plurality of pathways having a first opening at the manipulator end and a second opening at the lock end;

(b) a plurality of throw controls connected to the housing, each throw control including;

(i) a barrel adjustably connected to the housing along a corresponding pathway;

(ii) an elongate flexible probe sized to be slideably received through the pathway and a length of the barrel, (iii) a plunger connected to the probe;

(iv) a retaining cap connected to the barrel movable among a plurality of positions to capture a portion of the plunger therebetween; and (c) a locking mechanism connected to the barrel and contactable with the retaining cap for retaining the retaining cap at a given position with respect to the barrel.

2. The tool of claim 1, wherein the barrel is threadingly engaged with the housing.

3. The tool of claim 1, wherein the housing includes an inner body and an outer body sized to receive a portion of the inner body.

4. The tool of claim 1, wherein the retaining cap is threadingly engaged with the barrel.

5. The tool of claim 1, wherein the locking mechanism is threadingly engaged with the barrel.

6. A tool for opening a lock, comprising:

(a) a main housing having a lock end, a manipulator end and a plurality of pathways having a first opening at the manipulator end and a second opening at the lock end;

(b) a plurality of throw controls connected to the housing, each throw control including;

(i) a threaded barrel sized to engage a threaded section of a given pathway;

(ii) an elongate flexible probe sized to be slideably received through the pathway and a length of the barrel, (iii) a plunger connected to the probe;

(iv) a retaining cap threadingly engaged to the barrel to capture a portion of the plunger therebetween, the retaining cap movable between an adjusting position permitting movement of the plunger relative to the barrel and a secure position substantially precluding movement of the plunger relative to the barrel.

7. The tool of claim 6, further comprising a barrel lock for releasably retaining the barrel relative to the housing.

8. The tool of claim 6, further comprising a retaining cap lock for releasably retaining the retaining cap relative to the barrel.

9. The tool of claim 6, wherein the plunger includes a stop sized to be retained between a portion of the retaining cap and a portion of the barrel.

10. The tool of claim 6, wherein the housing includes a flared section and the pathways open in the flared section.

11. The tool of claim 6, wherein the probe is a flexible wire.

12. A tool for picking a lock, comprising:

(a) a main housing having a lock end and a manipulator end, the manipulator end including a plurality of pathways, each pathway having an opening at the manipulator end;

(b) a plurality of throw controls connected to the housing, each throw control including;

(i) a barrel connected to the housing to align with a given opening;

(ii) an elongate flexible probe sized to be slideably received through a pathway and a length of the barrel;

(iii) a plunger connected to the probe; and (iv) a retaining cap threadingly engaged to the barrel to capture a portion of the plunger therebetween, the retaining cap movable between an adjusting position permitting movement of the plunger relative to the barrel and a secure position substantially precluding movement of the plunger relative to the barrel.

13. The tool of claim 12, wherein the retaining cap includes an aperture sized to pass a portion of the plunger and preclude passage of the entire plunger therethrough.

* * * * *

UNITED STATES PATENT AND TRADEMARK OFFICE

CERTIFICATE OF CORRECTION

PATENT NO. : 6,230,529 B1
DATED : May 15, 2001
INVENTOR(S) : Kenneth E. Persson

It is certified that error appears in the above-identified patent and that said Letters Patent is hereby corrected as shown below:

Item [57] ABSTRACT

A tool is disclosed for opening tubular locks in which a tubular key is received. The tool includes a plurality of probes that are releasably retained and secured in a given position to align the shear points in the lock in an opening position. The probes can be ergonomically and individually manipulated and have a course and a fine adjustment means, such that the shear point of each tumbler can be easily and efficiently determined. Once the sheer point is determined, the probe may be fixed in the position to maintain each tumbler driver.

Signed and Sealed this

Eleventh Day of September, 2001

*Attest:*

Nicholas P. Godici

*Attesting Officer*

NICHOLAS P. GODICI
*Acting Director of the United States Patent and Trademark Office*